US011932920B2

(12) United States Patent
Prigent et al.

(10) Patent No.: US 11,932,920 B2
(45) Date of Patent: Mar. 19, 2024

(54) DEVICE FOR TRAPPING HYDROGEN

(71) Applicant: CONSTELLIUM ISSOIRE, Issoire (FR)

(72) Inventors: Jocelyn Prigent, Voreppe (FR); Philippe Jarry, Grenoble (FR); Pierre Le Brun, Saint Jean de Soudain (FR)

(73) Assignee: CONSTELLIUM ISSOIRE, Issoire (FR)

( * ) Notice: Subject to any disclaimer, the term of this patent is extended or adjusted under 35 U.S.C. 154(b) by 118 days.

(21) Appl. No.: 17/615,922

(22) PCT Filed: Jun. 3, 2020

(86) PCT No.: PCT/FR2020/050948
§ 371 (c)(1),
(2) Date: Dec. 2, 2021

(87) PCT Pub. No.: WO2020/245542
PCT Pub. Date: Dec. 10, 2020

(65) Prior Publication Data

US 2022/0340999 A1 Oct. 27, 2022

(30) Foreign Application Priority Data

Jun. 7, 2019 (FR) ..... 1906094

(51) Int. Cl.
*C22B 34/12* (2006.01)
*C21C 7/072* (2006.01)
(Continued)

(52) U.S. Cl.
CPC ..... *C22B 34/1295* (2013.01); *C21C 7/072* (2013.01); *C22B 9/05* (2013.01); *C22B 21/064* (2013.01)

(58) Field of Classification Search
CPC ..... C22B 34/1295; C22B 9/05; C22B 21/064; C21C 7/072
See application file for complete search history.

(56) References Cited

U.S. PATENT DOCUMENTS 3,516,819 A 6/1970 Parlee et al.
3,961,778 A 6/1976 Carbonnel et al.
(Continued)

FOREIGN PATENT DOCUMENTS

FR 2621495 A1 * 4/1989
JP H0790409 A 4/1995
(Continued)

OTHER PUBLICATIONS

International Search Report, dated Oct. 15, 2020, corresponding to International Application No. PCT/FR2020/050948.

*Primary Examiner* — Scott R Kastler
(74) *Attorney, Agent, or Firm* — LADAS & PARRY LLP

(57) ABSTRACT

Liquid metal degassing device comprising a chamber containing a liquid metal bath, a device for circulating a gas through a purification chamber and in that the purification chamber comprises a getter material configured to trap dihydrogen from the circulating gas. Method for degassing a liquid metal bath to reduce the hydrogen concentration of the liquid metal comprising the following steps a) Preparing a liquid metal bath, preferably an aluminum alloy b) Circulating a gas, c) Exchanging hydrogen from the circulating gas with the liquid metal such that the hydrogen dissolved in the liquid metal bath diffuses into the circulating gas and enriches the circulating gas with dihydrogen, (Continued)

d) Purifying the circulating gas enriched with dihydrogen in a purification chamber comprising a getter material configured to trap dihydrogen from the circulating gas.

17 Claims, 2 Drawing Sheets

(51) Int. Cl.
*C22B 9/05* (2006.01)
*C22B 21/06* (2006.01)

(56) References Cited

U.S. PATENT DOCUMENTS

| | | | | |
|---|---|---|---|---|
| 4,003,560 | A | 1/1977 | Carbonnel | |
| 5,917,114 | A | 6/1999 | Rapp | |
| 6,425,998 | B1 * | 7/2002 | Cholewa ..... | C10G 35/00 585/407 |
| 2012/0090432 | A1 | 4/2012 | Bryant et al. | |
| 2018/0044761 | A1 | 2/2018 | Mitchell et al. | |

FOREIGN PATENT DOCUMENTS

| | | | |
|---|---|---|---|
| WO | 95/21273 | A1 | 8/1995 |
| WO | 99/34024 | A1 | 7/1999 |

* cited by examiner

[Fig. 1]
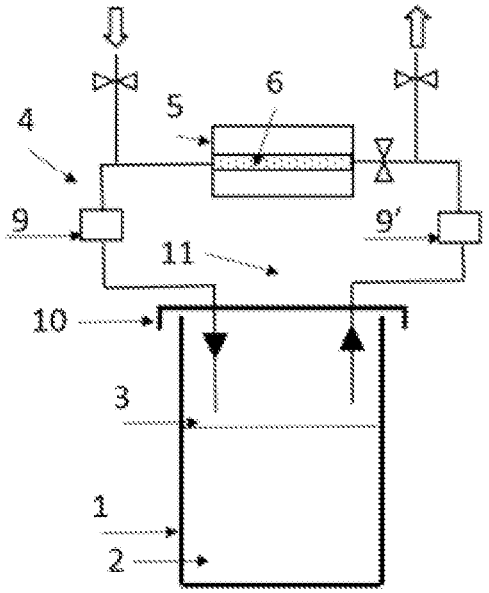
[Fig. 2]
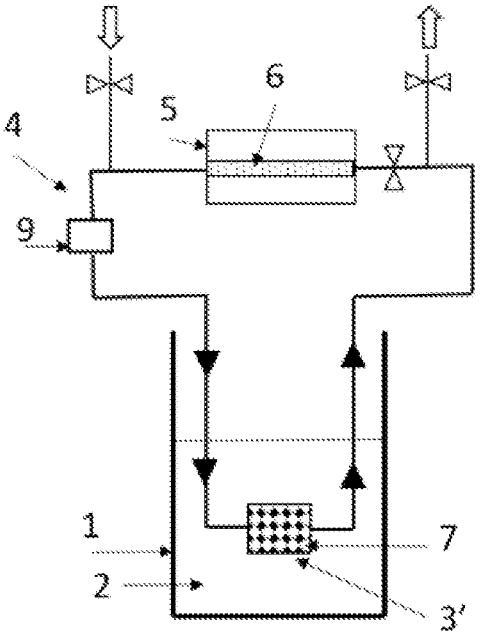

[Fig. 3]
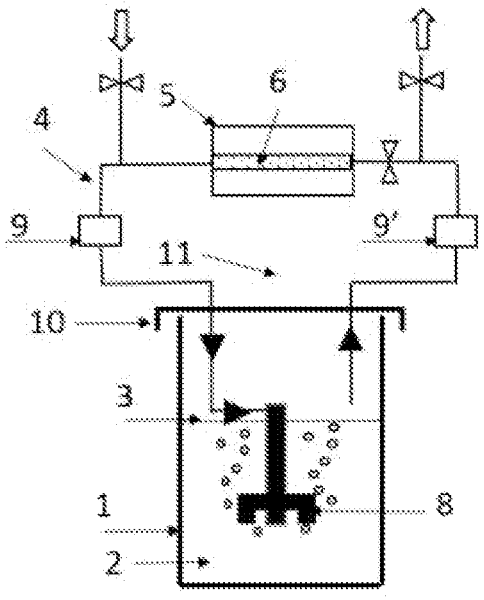
[Fig. 4]
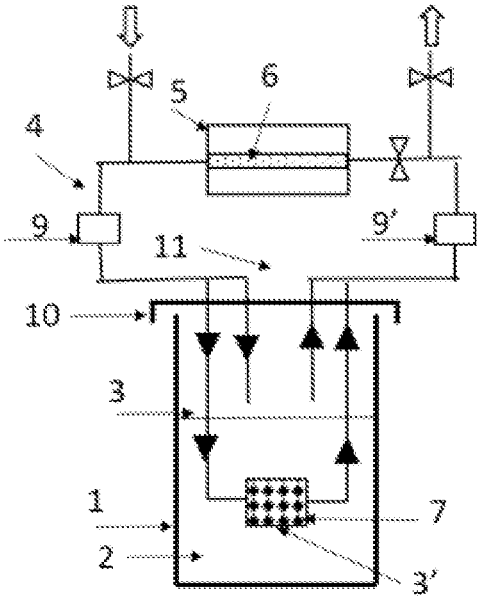

DEVICE FOR TRAPPING HYDROGEN

TECHNICAL FIELD

This invention relates to a device for reducing the quantity of hydrogen dissolved in a liquid metal bath using a hydrogen trap. It also discloses a method for reducing the quantity of hydrogen dissolved in a liquid metal bath. This invention also relates to the use of such a device in a liquid metal, in particular aluminum alloy, casting installation.

PRIOR ART

Hydrogen is a soluble gas in metals, in particular in iron, titanium and aluminum. In aluminum, hydrogen is the only soluble gas. The maximum dissolved hydrogen concentration differs by an order of magnitude between liquid aluminum and solid aluminum.

Thus, an excessively large quantity of hydrogen dissolved in a liquid aluminum alloy induces porosity formation during solidification.

In order to reduce the quantity of hydrogen in the liquid metal, the metal casting is generally performed in a protective atmosphere, for example in argon, and/or the liquid metal undergoes online degassing during casting.

This degassing process consists of injecting argon in bubble form into the liquid metal. The gas phase being depleted of dihydrogen, the hydrogen present in the liquid metal tends to diffuse to the argon bubbles thus transporting the hydrogen outside the metal according to the principle of Sieverts law. According to the principle of Sieverts law, the solubility of a diatomic gas in a metal is proportional to the square root of the partial pressure of this gas at thermodynamic equilibrium.

WO9521273 discloses a process consisting of introducing molten metal into a tank, such as the tank provided between a melting furnace and a casting machine, providing at least one gas injector and injecting a gas into the liquid metal to form gas bubbles in the metal while moving the injector(s) mechanically in order to minimize the size of the bubbles and maximize the distribution of the gas in the metal.

WO9934024 discloses another type of injector for performing the same process and injecting gas into a molten metal.

The process, though robust and tried-and-tested, has several drawbacks. Firstly, it uses large quantities of argon, several tens of cubic meters per hour and per casting. It also requires a burdensome installation that is costly to maintain (ladle of liquid aluminum, injection rotors, pressurized gas installation, etc.). Finally, argon bubbling agitates the metal which generates the formation of dross which must be removed regularly at the risk of damaging the inclusion quality of the metal.

These problems posed by degassing by bubbling inert gas also apply to iron, magnesium, and titanium, and to iron, magnesium, and titanium alloys.

DESCRIPTION OF THE INVENTION

The subject matter of the invention proposes a degassing device and a degassing process for reducing the quantity of gas used for degassing the liquid metal.

This problem is solved thanks to a liquid metal degassing device comprising a chamber containing a liquid metal bath, a device for circulating a gas through a purification chamber.

The circulating gas and said liquid metal bath are in contact and form an interface. The liquid metal bath is capable of containing dissolved hydrogen. Preferably, the chamber is configured to prevent the circulating gas from mixing with the outside atmosphere.

The circulating gas is in contact with the liquid metal bath and forms an interface. At this interface, an exchange may occur between the hydrogen present in the liquid metal and the circulating gas: the hydrogen dissolved in the liquid metal bath diffuses through the interface to the circulating gas. The circulating gas being depleted of dihydrogen, the hydrogen present in the liquid metal tends to diffuse through the interface to the gas which is then enriched with dihydrogen and thus transports the hydrogen out of the metal to the purification chamber.

Essentially, the purification chamber comprises a getter material configured to trap dihydrogen from the circulating gas. The purification chamber is an enclosed space configured to enable the input of the circulating gas, capable of being enriched with dihydrogen, and to enable the output of the circulating gas after interacting with the getter material.

It is advantageous for the circulation device to have blowing and/or suction means capable of enabling contact of said circulating gas with the liquid metal bath.

Within the scope of this invention, the getter material makes it possible to trap dihydrogen irreversibly under normal operating conditions. It is however possible to regenerate the getter material so as to renew its trapping capacities, for example by heating it or by any other suitable manner.

A getter material is a material including, intrinsically and/or due to the microscopic or nanoscopic morphology thereof, absorbent and/or adsorbent properties in respect of gaseous molecules, here dihydrogen, thus capable of embodying a chemical gas pump when the latter is disposed in an enclosed environment. The presence of a getter material in the purification chamber makes it possible to lower the dihydrogen concentration in the gas contained in the purification chamber and thus enable recirculation of dihydrogen-depleted gas.

It is advantageous for the getter material to be a material for trapping dihydrogen from the gas by physisorption which is a specific mode of adsorption or by chemisorption which is a specific mode of absorption. Advantageously, the getter material is a material for trapping dihydrogen by hydridation, which is a specific mode of chemisorption. Preferably, the material for trapping dihydrogen from the gas is a material based on Ni or other suitable materials. Preferably, the material for trapping dihydrogen from the gas by chemisorption is an intermetallic compound based on zirconium for example FeZr2, or magnesium or yttrium or rare earths or titanium or other suitable materials. Advantageously, the material for trapping dihydrogen from the gas by physisorption or chemisorption is combined with a catalyst configured to break down the dihydrogen from the gas into a hydrogen monomer; typically, palladium or a niobium oxide can be used as a catalyst.

Preferably, the circulating gas is in contact with the liquid metal bath via an exchanger, submerged in the liquid metal bath and capable of forming an interface between the liquid metal bath and the circulating gas.

It is advantageous for the exchanger to be a porous ceramic. Preferably, an open-porosity ceramic. This enables the circulating gas to circulate through the pores. In the case of a porous ceramic, the interface between the liquid metal bath and the circulating gas corresponds to the area of the opening pores.

The term "pore" denotes a void wherein the gas can circulate but which the metal cannot enter. The term "open porosity" denotes a porosity such that the voids form a network and communicate with one another.

In another embodiment, preferably, the circulating gas is in contact with the liquid metal bath via an injector submerged in the liquid metal bath and capable of forming an interface between the liquid metal bath and the circulating gas. The injector is capable of forming gas bubbles in the liquid metal bath. The interface is preferably spherical or quasi-spherical in shape.

According to the embodiment of the invention, the interface between the circulating gas and the liquid metal bath can be a free surface or a spherical or quasi-spherical surface or any porous surface. The term free surface denotes the horizontal surface of the liquid metal bath. The term spherical or quasi-spherical surface denotes the case where the gas is introduced into the liquid metal via an injector and is found in the form of bubbles of spherical or quasi-spherical shape.

It is advantageous for the circulating gas to be an inert gas, preferably argon.

Preferably, the chamber is configured to prevent the circulating gas from coming into contact with the external atmosphere. This containment can be obtained by cover means of the chamber or any other means for preventing the circulating gas from coming into contact with the external atmosphere.

The liquid metal can be aluminum or an aluminum or iron alloy or an iron or titanium alloy or a titanium or magnesium alloy or a magnesium alloy or any other metal or alloy capable of containing dissolved hydrogen.

The invention also relates to a method for degassing liquid metal to reduce the hydrogen concentration of the liquid metal. This method comprises the use of a degassing device according to the invention. In particular, the method for degassing liquid metal to reduce the hydrogen concentration of the liquid metal comprises the following steps:

a) Preparing a liquid metal bath, preferably an aluminum alloy or an iron alloy or a titanium alloy or a magnesium alloy or any other metal or alloy capable of containing dissolved hydrogen,
b) Circulating a gas in the degassing device, preferably an inert gas, preferably argon such that the circulating gas is in contact with the liquid metal bath and forms a liquid metal bath/circulating gas interface,
c) Exchanging hydrogen between the circulating gas and the liquid metal through the liquid metal bath/circulating gas interface such that the hydrogen dissolved in the liquid metal bath diffuses in the circulating gas and enriches the circulating gas with dihydrogen,
d) Purifying the circulating gas enriched with dihydrogen in a purification chamber comprising a getter material configured to trap dihydrogen from the circulating gas.

Preferably, the circulation of the gas in step b is performed using blowing and/or suction means capable of contacting said circulating gas and the liquid metal bath. This creates a liquid metal bath/circulating gas interface.

In the case where the circulating gas remains on the surface of the liquid metal bath and is not introduced into the liquid metal bath, the liquid metal bath/circulating gas interface corresponds to the free surface of the liquid metal bath.

According to another embodiment of the invention, the circulation of the gas in step b is performed via an exchanger, preferably made of porous ceramic, submerged in the liquid metal bath (2).

According to another embodiment of the invention, the circulation of the gas in step b is performed via an injector.

The invention also relates to the use of a degassing device according to the invention in a casting device, preferably an aluminum alloy casting device. Preferably, the degassing device is installed in a degassing ladle or a distribution trough or any other part of the casting device containing circulating liquid metal. It is also advantageous to use the degassing device in a furnace, typically a static furnace or a holding furnace or a preparation furnace or any other part of the casting device containing liquid metal waiting to be cast. The term "waiting to be cast" denotes liquid metal contained in a furnace or a ladle or a part of the device which is statically contained in a furnace before being solidified; for example, liquid metal prepared in a crucible, stored in the crucible before being solidified in a mold.

FIGURES

FIG. 1 is a schematic view of the device according to the invention according to a first embodiment where the circulating gas is in contact with the liquid metal bath, the interface being a free surface of the liquid metal.

FIG. 2 is a schematic view of the device according to the invention according to a second embodiment where the circulating gas is in contact with the liquid metal bath via an exchanger.

FIG. 3 is a schematic view of the device according to the invention according to a third embodiment wherein a gas injector is used in the liquid metal.

FIG. 4 is a schematic view of the device according to the invention according to a fourth embodiment which comprises the first and the second embodiment together.

DETAILED DESCRIPTION OF THE INVENTION

FIG. 1 discloses a first embodiment of the invention. It discloses a liquid metal degassing device comprising a chamber 1 containing a liquid metal bath 2, a device 4 for circulating a gas which passes through a purification chamber 5. The gas, preferably an inert gas, for example argon, is in contact with the liquid metal bath via an interface 3. This interface 3 is in this embodiment a free surface of the liquid metal. The gas can be injected into the circulating device 4 thanks to a gas inlet. A valve device makes it possible to open or close the gas supply as needed. A vent system can also be added to the device. Similarly, a valve system is used to discharge the circulating gas if needed (for example during maintenance of the purification chamber 5).

A blowing means 9 can be added to the circulation loop 4 to ensure a sufficient gas flow in contact with the interface 3. However, it is necessary to ensure that this flow is not excessive to prevent excessive agitation of the liquid metal. It is possible to use a suction device 9' in addition to or instead of the blowing means 9.

According to the principle of Sieverts Law, at the interface 3, the quantity of hydrogen dissolved in the liquid metal is at thermodynamic equilibrium with the partial pressure of dihydrogen gas contained in the gas. Thus, the lower the partial pressure of dihydrogen gas, the greater the decrease in the dissolved hydrogen concentration in the liquid metal. Prior art installations use a continuously replenished inert atmosphere to obtain the lowest partial pressure of dihydrogen. The aim of the invention is that of continuously treating the circulating gas in a purification chamber by placing it in contact with a getter material configured to trap dihydrogen and thus lower the partial pressure of dihydrogen of the circulating gas. Preferably, the circulating gas is in a closed circuit.

The purification chamber 5 comprises a getter material 6 configured to trap dihydrogen from the circulating gas.

Materials exist that are capable of forming compounds with hydrogen and therefore of trapping this gas in solid form, hereinafter referred to as "getter material" or "getter".

Dihydrogen can be trapped by physisorption or by chemisorption. The material for trapping dihydrogen from the gas by physisorption is preferably a material based on Ni or any other material enabling the physisorption phenomenon. The material for trapping dihydrogen from the gas by chemisorption is preferably an intermetallic compound based on zirconium for example $FeZr_2$, or magnesium or yttrium or rare earths or titanium or any other material enabling the chemisorption phenomenon.

In order to accelerate trapping, it is preferable to associate a catalyst with the getter material.

The getter material can be sensitive to the presence of oxygen and can require the use of an inert circulating gas, preferably argon. Preferably, the chamber is configured to prevent the circulating gas from coming into contact with the ambient atmosphere. This containment can be obtained by cover means 10 of the chamber 1 or any other means for preventing the circulating gas from coming into contact with the external atmosphere 11.

FIG. 2 discloses a second embodiment of the invention. As in the first embodiment, it discloses a liquid metal degassing device comprising a chamber 1 containing a liquid metal bath 2, a device 4 for circulating a gas which passes through a purification chamber 5. The purification chamber 5 is of the same type as that described in the first embodiment and can use the same types of getter material. A gas inlet and a vent system can also be added as in the first embodiment. A blowing means 9 can be added to the circulation loop 4 to set the circulating gas flow.

In this second embodiment, the circulation device comprises an exchanger 7, submerged in the liquid metal bath 2. The gas is placed in contact with the liquid metal bath via the exchanger 7. The gas circulates inside the exchanger. The exchanger is configured to enable contact between the circulating gas and the liquid metal bath. Preferably, the exchanger is a porous ceramic wherein the geometry of the pores is adapted to prevent the liquid metal from entering the ceramic pores. Preferably, the pore size is between 50 μm and 1 mm.

Preferably, it is of interest to maximize the interface 3. This is possible by choosing an exchanger geometry with the greatest apparent surface area. Preferably, the exchanger is a ceramic foam made of SiC.

FIG. 3 discloses a third embodiment. As in the first and second embodiments, it discloses a liquid metal degassing device comprising a chamber 1 containing a liquid metal bath 2, a device 4 for circulating a gas which passes through a purification chamber 5. The purification chamber 5 is of the same type as that described in the first embodiment and can use the same types of getter material 6. A gas inlet and a vent system can also be added as in the first embodiment. A blowing means 9 and suction means 9' can be added to the circulation loop 4 as in the two other embodiments.

In this third embodiment, the circulation device 4 comprises an injector 8 which enables bubbling of the circulating gas in the liquid metal, preferably an inert gas. Typically, bubbling is performed on the same principle as the applications WO9521273 or WO9934024. Each bubble defines an interface; this interface is the envelope of the bubble. The interface has a spherical or quasi-spherical shape. Each bubble is in contact with the liquid metal and thus defines an interface. In this case, the interface area is related to the sum of the surface areas of bubbles present in the liquid metal.

This interface is in contact with the circulating gas. By means of the bubbling and based on the principle of Sieverts Law, the dissolved hydrogen content of the metal tends to decrease. The bubbles rising to the surface can then be sucked in by the suction means 9' to be subsequently treated in the purification chamber 5. Preferably, the chamber is configured to prevent the circulating gas from coming into contact with the ambient atmosphere. This containment can be obtained by cover means 10 of the chamber 1 or any other means for preventing the circulating gas from coming into contact with the external atmosphere 11

In a preferred embodiment of the invention, it is advantageous to associate the different embodiments together, pairwise or all together.

FIG. 4 discloses a fourth embodiment which associates the first and the second embodiments.

EXAMPLE

In order to study the exchange kinetics between the liquid metal and the circulating gas via a ceramic exchanger (as used in the configuration in FIG. 2), the following experiment was performed.

10 kg of an AG5 type aluminum alloy, consisting of 5% magnesium and 95% aluminum and 5 ppm of beryllium are melted in a graphite clay crucible at a temperature of about 700° C. An industrial type argon gas is circulated at a variable flow $D_{Ar}$ at a regulated pressure of 1.2 bar thanks to a pressure gauge-regulator via an exchanger submerged in the liquid metal.

The exchanger is a porous material made of SiC ceramic foam. Two geometries were tested; a first exchanger of dimensions 50×50×25 mm developing an apparent exchange surface area of 87.5 $cm^2$ and a second exchanger of dimensions 100×100×25 mm of apparent exchange surface area of 275 $cm^2$. The SiC ceramic foam is perforated to insert stainless steel tubes for circulating argon gas inside the porous material. The stainless steel tubes are sealed in the porous material with refractory cement. Flow meters are disposed at the inlet and outlet of the exchanger in order to detect any leak or any clogging.

The dihydrogen extracted by the process and contained in the gas at the exchanger outlet is quantified by an AMS 6420 type analyzer. The measurement is electrochemical type and gives the volume fraction of dihydrogen in a gaseous mixture at ambient pressure. It is then possible to deduce the volume of dihydrogen extracted for a time t according to the expression:

$$V_{H2} = \frac{C_{H2} D_{Ar}}{t} \quad \text{[Math 1]}$$

Where $C_{H2}$ is the volume fraction of dihydrogen in % and $D_{Ar}$ is the argon flow in normal liters/hour.

The molar quantity of dihydrogen ($n_{H2}$) extracted is deduced from the ideal gas law according to the formula:

$$n_{H2} = \frac{P}{RT} \frac{C_{H2} D_{Ar}}{t} \quad \text{[Math 2]}$$

Where P is the pressure and T is the temperature of the argon flow, i.e., 1 bar and 20° C. R is the universal ideal gas constant 8.31 J $mol^{-1} \cdot K^{-1}$.

Table 1 below gives the quantity of dihydrogen discharged in one hour by the porous material according to the effective exchange surface area and the argon flow scavenging inside the porous material. It is thus observed that the quantity of dihydrogen extracted increases with the effective exchange surface area of the porous materials and with the argon flow.

TABLE 1

Measurement of the quantity (mmol/h) of hydrogen discharged at the outlet of the submerged ceramic exchanger according to the injected argon flow (l/h) and the apparent surface area of the exchanger.

| | | Argon flow (l/h) | | |
|---|---|---|---|---|
| | | 2 | 4 | 8 |
| Apparent exchange surface area ($cm^2$) | 87.5 $cm^2$ | 9.2 mmol/h | 15.5 mmol/h | 21.2 mmol/h |
| | 275 $cm^2$ | 28.3 mmol/h | 42.5 mmol/h | 62.7 mmol/h |

The invention claimed is:

1. A liquid metal degassing device, comprising:

a chamber containing a liquid metal bath, a device for circulating a gas through a purification chamber, wherein said circulating gas and said liquid metal bath are in contact and form an interface, wherein the purification chamber comprises a getter material configured to trap dihydrogen from the circulating gas, and wherein the device for circulating the gas comprises a blowing means and a suction means configured to place the circulating gas in contact with the liquid metal bath.

2. The device according to claim 1, wherein the getter material traps dihydrogen from the circulating gas by physisorption or by chemisorption.

3. The device according to claim 1, wherein the getter material is regenerated.

4. The device according to claim 1, wherein the chamber is configured to prevent the circulating gas from coming into contact with the external atmosphere.

5. A method for degassing a liquid metal to reduce the hydrogen concentration of the liquid metal, comprising:

providing the liquid metal degassing device according to claim 1, bringing the circulating gas and the liquid metal into contact to form an interface, trapping the dihydrogen from the circulating gas by the getter material, and at least one of the steps of:

circulating the circulating gas by the blowing means and the suction means, and, bringing the circulating gas into contact with the liquid metal bath via Ere an exchanger.

6. The method according to claim 5, comprising the following steps:

a) preparing a liquid metal bath of an aluminum alloy, an iron alloy, a titanium alloy, or any other metal or alloy capable of containing dissolved hydrogen, b) circulating a gas in the degassing device, the circulating gas being argon, wherein the circulating gas is in contact with the liquid metal bath and forms a liquid metal bath/circulating gas interface, c) exchanging hydrogen between the circulating gas and the liquid metal through the liquid metal bath/circulating gas interface such that the hydrogen dissolved in the liquid metal bath diffuses in the circulating gas and enriches the circulating gas with dihydrogen, d) purifying the circulating gas enriched with dihydrogen in the purification chamber comprising a getter material configured to trap dihydrogen from the circulating gas.

7. The method according to claim 5, wherein the exchanger is a porous ceramic exchanger submerged in the liquid metal bath.

8. The method according to claim 6, comprising circulating the gas via an injector submerged in the liquid metal bath.

9. A casting device comprising the liquid metal degassing device according to claim 1.

10. The device according to claim 9, wherein the liquid metal degassing device is installed in a degassing ladle, and/or a distribution trough, or any other part of the casting device containing circulating liquid metal.

11. The device according to claim 9, wherein the liquid metal degassing device is installed in a furnace.

12. The device according to claim 1, wherein the liquid metal bath comprises an exchanger submerged in the liquid metal bath, and configured to provide the interface between the liquid metal bath and the circulating gas.

13. The device according to claim 12, wherein the exchanger is a porous ceramic exchanger.

14. The device according to claim 1, wherein the device for circulating the gas comprises a blowing means and a suction means configured to place the circulating gas into contact with the liquid metal bath, and wherein the liquid metal bath comprises an exchanger submerged therein, and configured to provide the interface between the liquid metal bath and the circulating gas.

15. The method according to claim 10, comprising circulating the circulating gas by the blowing means and the suction means.

16. The method according to claim 5, comprising bringing the circulating gas into contact with the liquid metal bath via the exchanger.

17. The method according to claim 5, comprising circulating the circulating gas by the blowing means and the suction means, and bringing the circulating gas into contact with the liquid metal bath via the exchanger.

* * * * *